US005885951A

United States Patent [19]

Loder

[11] Patent Number: 5,885,951

[45] Date of Patent: Mar. 23, 1999

[54] AQUEOUS SOLUTION FOR TILE, TUB AND GROUT CLEANING

[75] Inventor: Edwin R. Loder, Boynton Beach, Fla.

[73] Assignee: Martin Panich, North Miami Beach, Fla.

[21] Appl. No.: 961,891

[22] Filed: Oct. 31, 1997

[51] Int. Cl.[6] ..... C11D 1/835; C11D 3/43

[52] U.S. Cl. ..... 510/238; 510/382; 510/384; 510/421; 510/466; 510/506

[58] Field of Search ..... 510/238, 421, 510/382, 384, 466, 506

[56] References Cited

U.S. PATENT DOCUMENTS 5,411,585 5/1995 Avery et al. ..... 106/287.1

OTHER PUBLICATIONS

McCutcheon's Emulsifiers and Detergents, 1997, vol. 1, p. 99, 1997.

*Primary Examiner*—Paul Lieberman
*Assistant Examiner*—Gregory E. Webb

A cleaner of the present type disclosed is a water based, alkaline product that might contain solvents, surface active agents, chelating agents, antimicrobial agents and/or other materials such as builders, fragrances and dyes. The combination of solvents, chelating agents and antimicrobial agents used in the present aqueous solution produces a clear, stable product exhibiting no precipitous effects where the solvents are selected from the groups consisting of glycol ethers, or low molecular weight alcohols, the surface active agents are selected from the non-ionic surfactants' type, the chelating agents are selected from the group consisting of nitriloacetates, and the antimicrobial agents are selected from the group consisting of silicone quaternary ammonium salts.

15 Claims, No Drawings

AQUEOUS SOLUTION FOR TILE, TUB AND GROUT CLEANING

FIELD OF THE INVENTION

The present invention pertains to an aqueous solution for tile, tub and grout cleaning, including the method of using the solution. More particularly the present aqueous solution comprises chelating and antimicrobial agents.

BACKGROUND OF THE INVENTION

Hard surface cleaners for kitchen and bath surfaces are generally water based, acid or alkaline products that might contain surface active agents, solvents, detergent builders, dyes and fragrances, to name a few examples of prior art components of such a composition. Some alkaline cleaners might also contain some form of chlorine or other agents that provide short term antimicrobial efficacy. These cleaners can be applied to a surface of intended use by manual means, for example, by use of a trigger spray or aerosol spray, and thereafter rubbed or scrubbed, and rinsed, to remove any soil present. The soil might consist of lime scale and other mineral deposits, soap scum, food residue, body oils and cosmetic residues. Such a surface substrate can be manufactured of tile, glass, grout, fiberglass or other polymeric materials that are conventionally used in kitchen and bathroom construction.

The prior art cleaners aforementioned have a serious drawback as they contain antimicrobial agents that provide short term antimicrobial activity. There are certain types of antimicrobial agents that provide extended antimicrobial activity but their use is incompatible with the usual components of hard surface cleaners. An unstable solution is formed that results in a precipitate. The precipitate extracts the antimicrobial agent from the solution eliminating its effectiveness as an antimicrobial and, to a lesser degree, as a cleaning agent as other components are removed as part of the precipitate. To the contrary, the combination of the chelating agents and the antimicrobial agents used in the present invention produces a clear, stable product exhibiting the cleaning and antimicrobial characteristics of these individual components.

SUMMARY OF THE INVENTION

It is thus an object of the present invention to provide an aqueous solution comprising a non-precipitous combination of solvents, chelating agents and antimicrobial agents.

It is another object of the present invention to provide an aqueous solution having exceptional soil, lime scale, and mineral deposit removal properties.

It is still another object of the present invention to provide an aqueous solution comprising antimicrobial agents which are uniquely capable of providing immediate and long term bactericidal properties to the surfaces cleaned as they are bonded to the surface, remaining thereon as active antimicrobial agents.

It is yet another object of the present invention to provide an aqueous cleaning solution capable of preventing the formation of mold and mildew and accompanying stains on surfaces for extended periods of time.

It is still yet another object of the present invention to provide a method for cleaning using aqueous cleaning solution that produces a surface free of soil, mineral deposits, and mold and mildew for extended periods of time without scrubbing or rinsing.

DETAILED DESCRIPTION OF A PREFERRED EMBODIMENT

The present invention of an aqueous solution comprises solvents, surface active agents, chelating agents, builders, fragrances (optionally), and antimicrobial agents. A preferred embodiment of the aqueous solution composition is shown below in Table 1, and is expressed in terms of percent by weight:

TABLE 1

| COMPONENT | PERCENT BY WEIGHT |
|---|---|
| Tetrasodiumethylenediaminetetraacetate | 12.2 |
| Dipropylene Glycol Monomethyl Ether | 1.4 |
| Nonylphenolpolyethylene Glycol Ether | 1.0 |
| Phosphoric Acid | 1.2 |
| 3-(trimethoxysilyl)propyloctadecyldimethyl Ammonium Chloride | 0.3 |
| Fragrance | 3.0 ounces per 100 gallons |
| Water | Balance |

The chelating agents are selected from the nitriloacetates and salts in a range of 5% to 15% by weight. These chelating agents are present to complex the calcium and magnesium salts that are present in hard water residues. The preferred chelating agent is tetrasodiumethylenediaminetetraacetate (Tetrasodium EDTA), such as that manufactured by Dow Chemical Co. Other chelating agents that may be used are, but are not limited to, diethylenetriaminepentacetic acid, nitrilotriacetic acid, N-hydroxyethylenediaminetriacetic acid and their salts and mixtures thereof.

The solution of Tetrasodium EDTA is preferably mixed in the aqueous solution for tile, tub and grout cleaning in an amount of 5% to 15% by weight. The other chelating agents may be used on an equivalent chelating strength basis.

The pH of the aqueous solution for tile, tub and grout cleaning may be moderated by adding phosphoric acid to decrease the pH depending upon the acidity level of the chelating agent used. The pH of the present aqueous solution is preferably in the range of 6.5 to 10, and more preferably in the range of 7.5 to 9. It has been found that an amount of phosphoric acid necessary to moderate the pH level according to this disclosure is in the range of 0.5% to 1.5% by weight, and preferably 1.2% by weight within the aqueous solution.

The solvents are selected from the glycol ethers or low molecular weight alcohols in a range of 0.5% to 5% by weight. The solvents are present to dissolve the body oils and soap oils that are present in soil residues encountered in hard surface cleaning. Possible glycol ethers that may be used comprise dipropylene glycol monomethyl ether, dipropylene glycol monobutyl ether, dipropylene glycol monopropyl ether, propylene glycol monopropyl ether, diethylene glycol monomethyl ether, and ethylene glycol monobutyl ether. A preferred glycol ether combination is dipropylene glycol monomethyl ether in an amount of 1.4% by weight and nonylphenol polyethylene glycol ether in an amount of 1.0% by weight. Low molecular weight alcohols may be substituted for some or all of the glycol ethers, some of which may include methyl alcohol and ethyl alcohol, and isopropyl alcohol is preferred.

The non-ionic surfactants are selected from the alkyl or aryl polyethylene glycol ethers or all versions of ethylene oxide chains containing a water soluble portion in a range of 0.5% to 3.0% by weight, and more preferably in a range of 1.0% to 1.5%. These surfactants are present to lower the surface tension of the water and provide improved wetting and detergency. The non-ionic surfactant preferably has a hydrophilic-lipophilic balance ("HLB") number of 13.0 or less, and more preferably 12.0 or less to avoid streaking. Antarox BL-225 (Rhone-Poulenc, Cranbury, N.J.) with an HLB of 12 and a cloud point of 27 degrees C or BASF Pluronic L-10 (Parsipanny, N.J.) with an HLB of 12 and a cloud point of 32 degrees C are preferred non-ionic surfactants.

The antimicrobial agents are selected from the silicone quaternary ammonium salts in a range of 0.1% to 2.5% by weight. These antimicrobial agents are present to provide immediate and long term residual antimicrobial activity. Suggested antimicrobial agents comprise (trimethoxysilyl) propyloctadecyidimethyl ammonium chloride, (triethoxysilyl)propyloctadecyidimethyl ammonium chloride, (trimethoxysilyl)butyloctadecyldimethyl ammonium chloride, and (trimethoxysilyl)propyldodecyldimethyl ammonium chloride. A preferred antimicrobial agent is 3-(trimethoxysilyl) propyloctadecyldimethyl ammonium chloride in an amount of 0.3% by weight.

A fragrance can be added, optionally, as used in like products. Examples of suitable fragrances include cherry aroma in a range of 1.0 to 5.0 ounces per 100 gallons of aqueous solution. If fragrance is to be used, a preferred amount is 3.0 ounces per 100 gallons.

A dye can be added, optionally, as used in like products. Examples of suitable dyes are available from Hilton Davis, one of which is Hidacid Azure Blue which is preferred. A technical blue dye can be used in a ranges from 0.0001% to 0.0005%. The preferred amount is 0.0003%.

The water used in the present aqueous cleaning solution is preferably distilled or deionized water. The water can be used to mix the composition of individual components as well as added to the balance of the composition.

The method of preparing the present aqueous cleaning solution comprises mixing the constituents to allow for complete and uniform solution composition. The preferred order of mixing is by beginning with water, adding the chelating agent, then adding the solvent, then adding the pH modifier, then adding the antimicrobial agent, and finally, adding an optional fragrance and/or dye.

It is intended that the description of the preferred embodiments of this invention is illustrative only. Other embodiments of the invention that are within the scope and concept of this invention are herein included with this application.

What is claimed is:

1. An aqueous cleaning solution comprising,

5% to 15% by weight of a chelating agent selected from the group consisting of ethylenediaminetetraacetic acids, diethylenetriaminepentaacetic acids, nitrilotriacetic acids, and N-hydroxyethylenediaminetriacetic acids, and mixtures and salts thereof, wherein the aqueous solution has a pH range of 6.5 to 10;

0.5% to 5.0% by weight of a solvent selected from the group consisting of dipropylene glycol monomethyl ether, dipropylene glycol monobutyl ether, dipropylene glycol monopropyl ether, propylene glycol monopropyl ether, diethylene glycol monomethyl ether, and ethylene glycol monobutyl ether, low molecular weight alcohols and mixtures thereof;

0.5% to 3.0% by weight of a nonionic surfactant selected from the group consisting of alkyl or aryl polyethylene glycol ethers and all versions of ethylene oxide chains containing a water soluble portion, and mixtures thereof;

0.1% to 2.5% by weight of an antimicrobial agent selected from the group consisting of (trimethoxysilyl) propyloctadecyldimethyl ammonium chloride; (triethoxysilyl)propyloctadecyldimethyl ammonium chloride, (trimethoxysily)butyloctadecyldimethyl ammonium chloride, and (trimethoxysilyl) propyldodecyldimethyl ammonium chloride, and mixtures thereof, and;

water.

2. The aqueous cleaning solution according to claim 1, wherein said aqueous solution has a pH in the range of about 7.5 to 9.0.

3. The aqueous cleaning solution according to claim 1, wherein said chelating agent is in the range of about 5% to 12.2% by weight.

4. The aqueous cleaning solution according to claim 1, wherein said solvent is in the range of about 0.5% to 2.4% by weight.

5. The aqueous cleaning solution according to claim 1, wherein said nonionic surfactant is in the range of about 1.0% to 1.5% by weight.

6. The aqueous cleaning solution according to claim 1, wherein said antimicrobial agent is 0.3% by weight.

7. The aqueous cleaning solution according to claim 1 further comprising a fragrance.

8. The aqueous cleaning solution according to claim 1 further comprising a dye.

9. The aqueous cleaning solution according to claim 1 further comprising an acid for adjusting the pH.

10. The aqueous cleaning solution according to claim 9, wherein said acid is phosphoric acid.

11. The aqueous cleaning solution according to claim 10, wherein said acid is in the range of about 0.5% to 1.5% by weight.

12. An aqueous cleaning solution for tub, tile and grout, comprising, a composition of tetrasodiumethylenediaminetetraacetate of about 12.2% by weight, dipropylene glycol monomethyl ether of about 1.4% by weight, nonylphenolpolyethylene glycol ether of about 1.0% by weight, 3-(trimethoxysilyl)propyloctadecyldimethyl ammonium chloride of about 0.3% by weight, and water.

13. In the aqueous cleaning solution of claim 12, said composition further comprising phosphoric acid of about 1.2% by weight.

14. In the aqueous cleaning solution of claim 13, said composition further comprising a fragrance of about 3 liquid ounces per 100 gallons of solution.

15. A method of manufacturing an aqueous cleaning solution, comprising mixing the following in order of appearance with mixing times sufficient to allow complete solution and uniform composition: water, tetrasodiumetbylenediaminetetraacetate of about 12.2% by weight, dipropylene glycol monomethyl ether of about 1.4% by weight, nonylphenolpolyethylene glycol ether of about 1.0% by weight, phosphoric acid of about 1.2% by weight, and 3-(trimethoxysilyl)propyloctadecyldimethyl ammonium chloride of about 0.3% by weight.

* * * * *